United States Patent [19]

Fottner

[11] Patent Number: 4,823,488

[45] Date of Patent: Apr. 25, 1989

[54] TUNNEL FINISHER HAVING REMOVABLE ROLLER ENVELOPES

[75] Inventor: Franz Fottner, Hilgertshausen-Tandern, Fed. Rep. of Germany

[73] Assignee: Veit GmbH & Co., Fed. Rep. of Germany

[21] Appl. No.: 174,711

[22] Filed: Mar. 29, 1988

[30] Foreign Application Priority Data

Mar. 31, 1987 [DE] Fed. Rep. of Germany ..... 3710674

[51] Int. Cl.[4] ..... D06F 61/06; D06B 23/16; D06B 23/02

[52] U.S. Cl. ..... 38/14; 38/8; 38/49; 68/5 C

[58] Field of Search ..... 38/1 A, 8, 9, 49, 14, 38/44; 198/463.6; 68/5 C, 5 D; 34/162; 8/149.3

[56] References Cited

U.S. PATENT DOCUMENTS 4,276,995 7/1981 Jennewein ..... 198/463.6
4,493,160 1/1985 Brembilla et al. ..... 38/14

FOREIGN PATENT DOCUMENTS 3519568 10/1986 Fed. Rep. of Germany .
WO8700218 1/1987 PCT Int'l Appl. ..... 38/1 A

*Primary Examiner*—Andrew M. Falik
*Attorney, Agent, or Firm*—Darby & Darby

[57] ABSTRACT

A tunnel finisher includes pneumatic rollers for defining an entrance and an exit for a pneumatic treatment chamber. The tunnel finisher is designed to facilitate the replacement of the envelope of pneumatic rollers.

The shaft of the pneumatic roller consists of an upper section fixedly mounted in the tunnel finisher housing, and a one-piece lower section carrying roller-supporting discs, with its upper end releasably coupled to the upper section, and its lower end tiltably supported on a tilt bearing.

The pneumatic rollers may thus be dismounted for simple and rapid replacement of the roller envelope, so that down-times of the tunnel finisher may be considerably reduced.

9 Claims, 3 Drawing Sheets

TUNNEL FINISHER HAVING REMOVABLE ROLLER ENVELOPES

BACKGROUND OF THE INVENTION

Field of the Invention

The invention relates to a tunnel finisher of the type defined in the generic clause of patent claim 1.

Description of the Related Art

A tunnel finisher of this type is known from DE-PS 35 19 568. This tunnel finisher comprises pneumatic rollers each having a shaft composed of two sections releasably interconnected between the bottom- and top-side discs by means of a tubular connecting portion. The tubular connecting portion is axially displaceable for separating the connection between the upper shaft section carrying the top-side disc and fixedly retained in the housing, and the lower shaft section carrying the bottom-side disc and likewise fixedly retained in the housing. This separation permits the cylindrical envelope of the pneumatic roller extending between the discs to be replaced. There is the disadvantage, however, that replacement of the envelope is only possible with the pneumatic rollers mounted in the tunnel finisher. Since in this state the pneumatic roller is not readily accessible from all sides, the replacement of the envelope is a fastidious and time-consuming operation due to the compact construction of tunnel finishers. It is particularly difficult to raise the tubular connecting portion within the envelope for separating the shaft sections from one another and at the same time to remove the envelope downwards. Similar difficulties are encountered during the installation of a new envelope.

It is therefore an object of the invention to facilitate the replacement of the envelope of a pneumatic roller in a tunnel finisher of the type defined in the introduction.

SUMMARY OF THE INVENTION

According to the invention, this object is attained in a tunnel finisher of the type defined having the characteristic features as set forth in the characterizing clause of patent claim 1.

Since the shaft is provided with a releasable coupling between its upper section fixedly retained in the housing and its one-piece lower section carrying the discs, and since the one-piece lower section is tiltably supported on a tilt bearing, the pneumatic roller can be readily dismounted from the tunnel finisher by a simple operation. In the dismounted state, the pneumatic roller is readily accessible from all sides, to thereby permit the envelope to be readily and quickly replaced. It is particularly advantageous that only that part of the pneumatic roller has to be tilted or dismounted which is required for the replacement of the envelope. The upper shaft section and the drive transmission wheel mounted thereon thus remain in the tunnel finisher as the one-piece lower shaft section is being dismounted.

Another advantageous aspect of the tunnel finisher is set forth in claim 2. A Z-shaped joint is capable over extended periods of time to effectively transmit a drive torque, because the interengaged end portions of the upper and lower shaft sections are kept in surface contact with one another. The transmission of the driving torque is assisted in a particularly simple manner by a clamp sleeve covering the location of the joint. A coupling of this type is practically maintenance- and wear-free and permits the connection to be rapidly separated by releasing and axial displacement of the clamp sleeve, so that only very short downtimes of the tunnel finisher are required for replacing the envelope.

The characteristic according to claim 3 offers the advantage that a fastener extending longitudinally of the sheet material web greatly facilitates the replacement of the envelope on the lower section of the vertical shaft. This characteristic is thus effective to further reduce the time required for the replacement of the envelope.

Independent protection is claimed for this arrangement of the fastener, because this characteristic is useful independent of the remaining construction of a tunnel finisher.

The characteristic according to claim 4 is also useful, because a Velcro fastener is rather inexpensive and does not leave any impressions on the clothing pieces to be treated, particularly when it extends along a helical line as specified by claim 5.

The advantageous provision according to claim 6 permits the upper end of the envelope to be readily pulled off the upper end of the lower shaft section, or to be slipped thereonto, respectively, during replacement of the envelope. Additional fastener elements are not required.

The provision finally according to claim 7 enables the tension of the envelope to be advantageously readjusted when so required due to elongation of the envelope under the influence of the compessed air injected at its lower end.

BRIEF DESCRIPTION OF THE DRAWINGS

An embodiment of the invention shall now be described by way of example with reference to the accompanying drawings, wherein.

DESCRIPTION OF THE PREFERRED EMBODIMENTS

Figure 1:
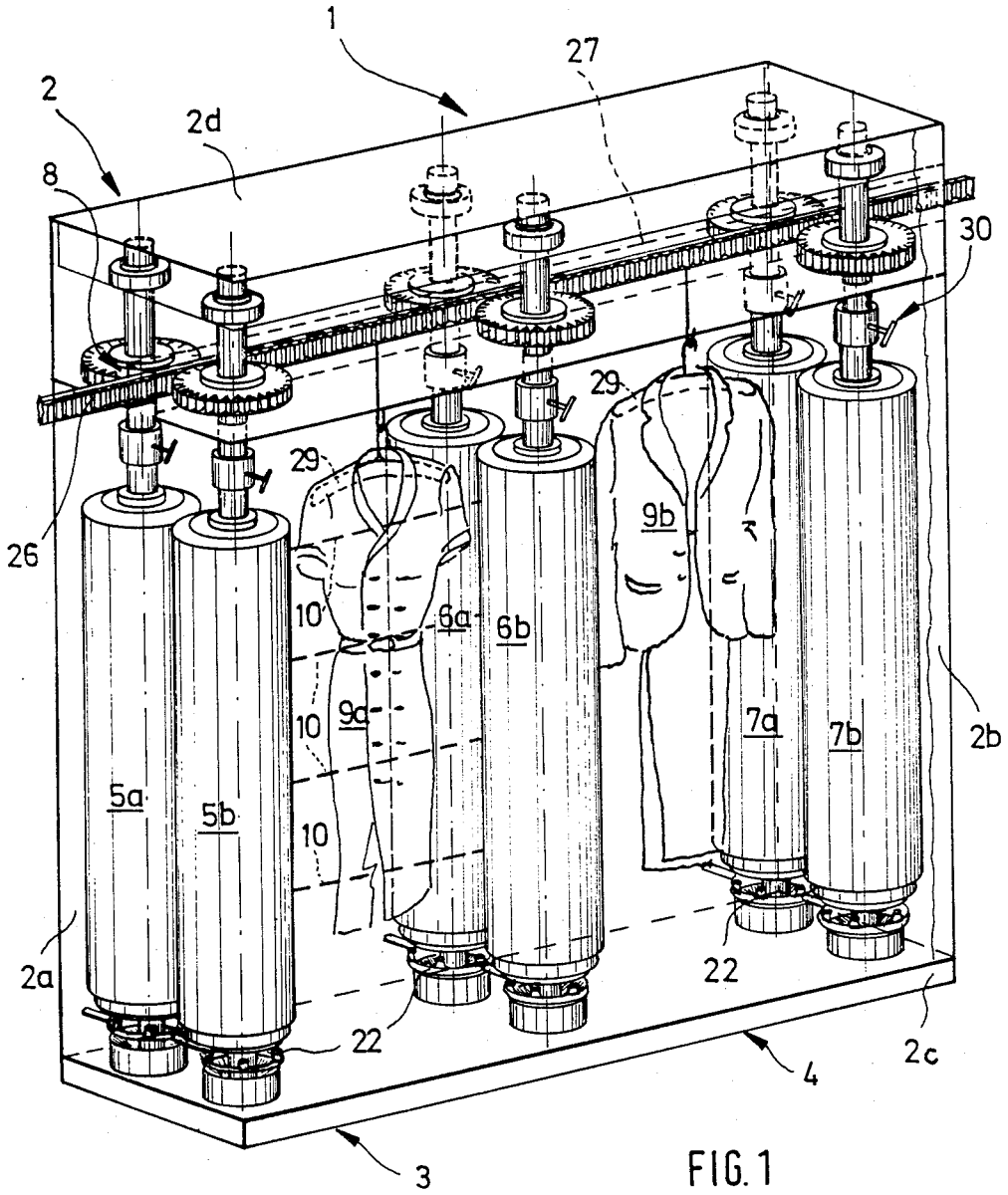
FIG. 1 shows a perspective view depicting the general construction of a tunnel finisher.

Shown in FIG. 1 is a tunnel finisher 1 for the treatment of crumple-free finishing of clothing articles. Tunnel finisher 1 has a housing 2 defined by sidewalls *2a, 2b,* a bottom wall *2c* and a top wall *2d.* Disposed in housing 2 are two chambers 3, 4 behind one another, the respective ends of which are defined by pairs of oppositely disposed pneumatic rollers *5a, b; 6a, b; 7a, b* with vertically extending longitudinal axes, so as to define two substantially enclosed chambers. The pneumatic rollers are mounted at fixed locations in the housing at their ends, and adapted to be rotated by a drive mechanism 8. The pneumatic rollers *5a, 6a* and *7a* mounted adjacent sidewall *2a* are thus rotatable in a counterclockwise direction while the pneumatic rollers *5b, 6b* and *7b* adjacent sidewall *2b* are rotatable in the clockwise direction. Chamber 3 contains means for the steam treatment of a clothing article *9a* from opposite sides, including a steam injector assembly 10 provided with steam nozzles (not shown) and connected to pipelines leading to a steam generator (not shown). Chamber 4 contains means for the subsequent drying and smoothing of the clothing articles, including a fan (not shown) operable to aspirate environmental air, to heat it, and to pass it through the chamber in the vertical direction.

Figure 2:
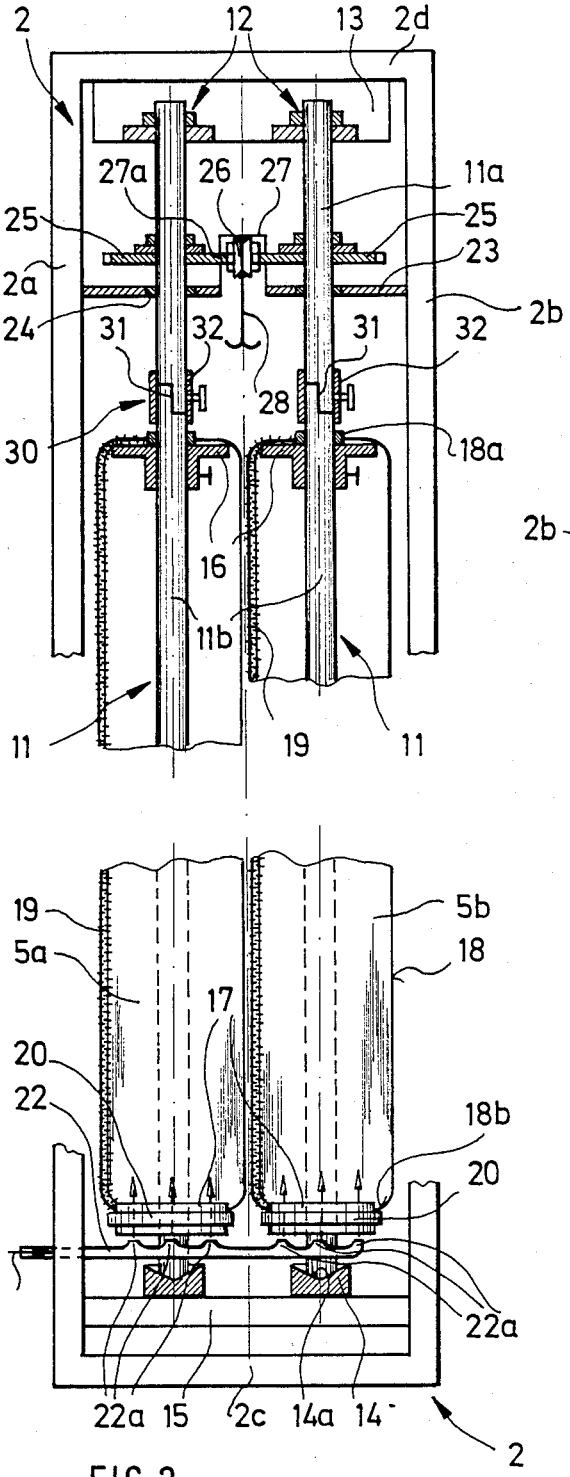
FIG. 2 shows a front end view of the tunnel finisher with two pneumatic rollers disposed opposite one another.
Figure 3:
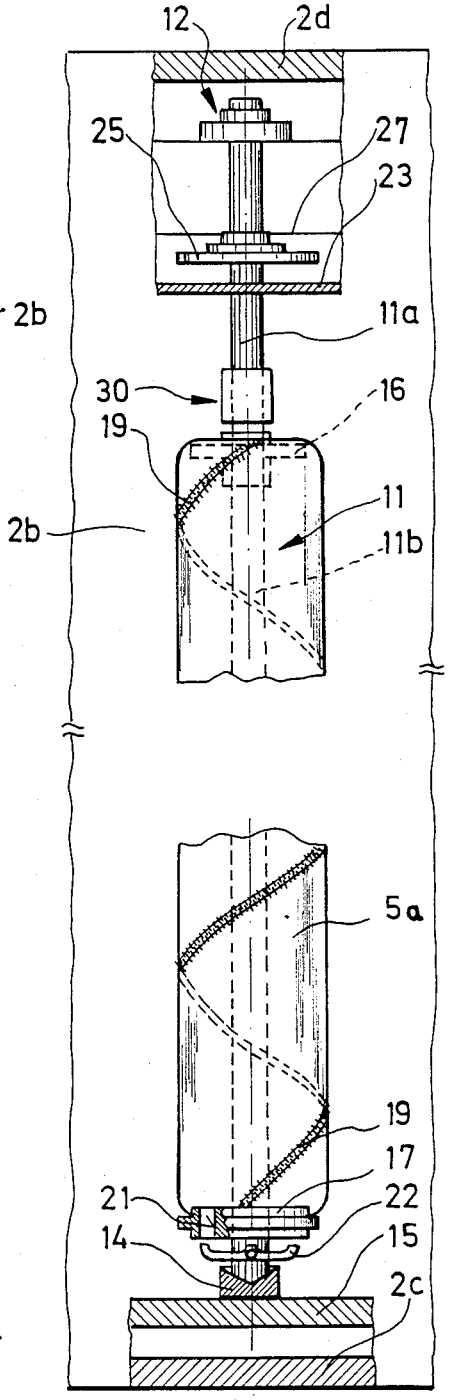
FIG. 3 shows a sideview of pneumatic rollers similar to the ones shown in FIG. 2, with a different fastener arrangement.
Figure 4:
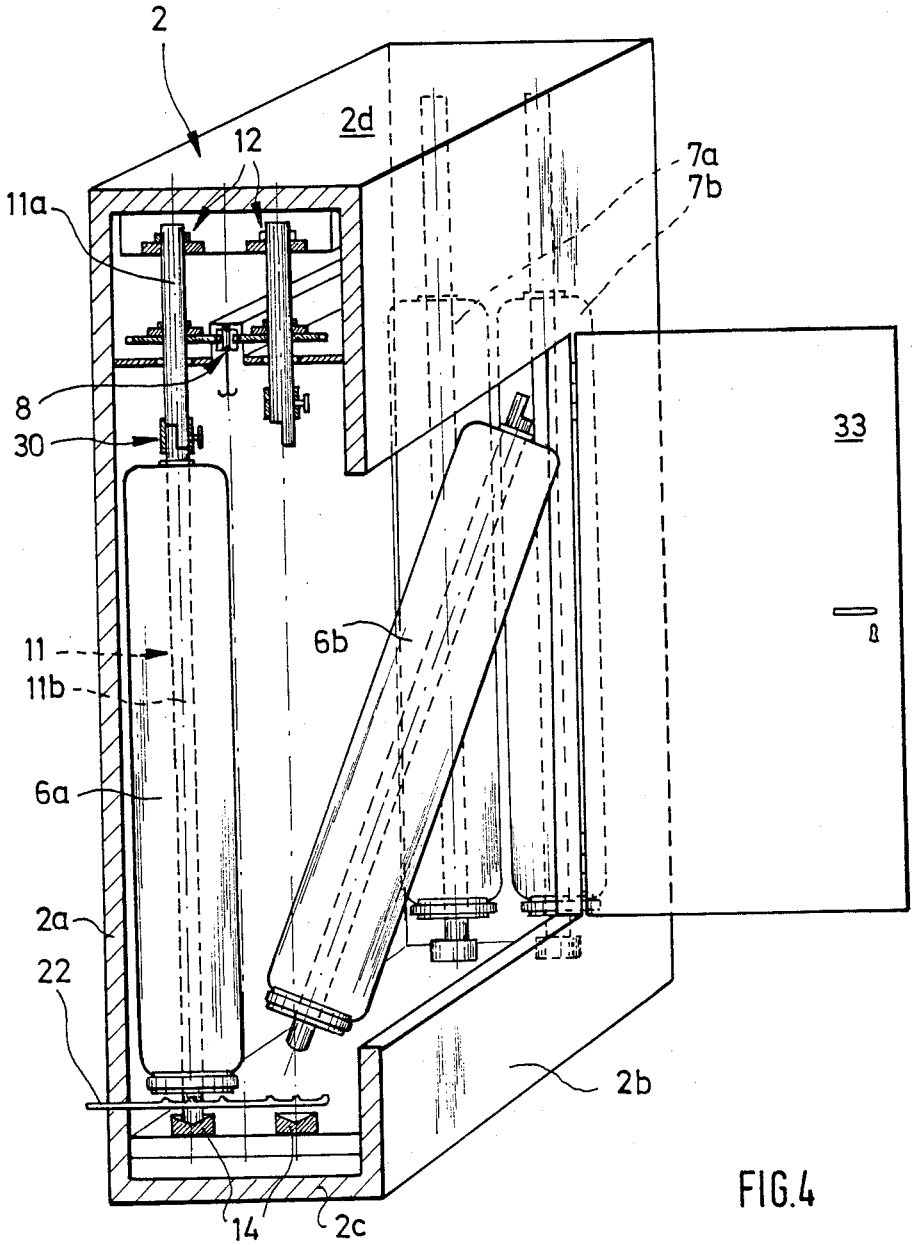
FIG. 4 shows a partially sectioned perspective view of the tunnel finisher during dismounting of a pneumatic roller.

The pneumatic rollers are shown in detail in FIGS. 2 and 3. Each pneumatic roller, for instance rollers 5*a*, 5*b* in FIG. 2, has a vertical shaft 11 with its upper end mounted in a bearing 12 secured to top wall 2*d* by means of a bearing support 13. The lower end of shaft 11 is supported in a tilt bearing 14 resting on a mounting plate 15. Shaft 11 is of two-piece construction including an upper section 11a mounted in bearing 12 and a lower section 11*b* supported in tilt bearing 14. Lower section 11*b* carries a top-side disc 16 adjacent its upper end, and a bottom-side disc 17 adjacent its lower end, disc 16 being releasably connected to shaft section 11*b*, while disc 17 is fixedly secured thereto. The cylindrical space extending between discs 16 and 17 is surrounded by an envelope 18 consisting of a flat sheet material web and provided with a fastener 19, preferably a Velcro fastener, extending vertically in die embodiment of FIG. 2, and along a helical line in the embodiment of FIG. 3. In the mounted state, envelope 18 has a circular hole 18*a* at its upper end, with an interior diameter slightly greater than the outer diameter of shaft 11, and at its lower end, an opening 18b having an inner diameter slightly greater than the outer diameter of bottom-side disc 17. The lower end of envelope 18 is sealingly secured to disc 17 by means of a clamp ring 20.

Bottom-side disc 17 is formed with a peripherally extending slot opening 21 communicating the interior of the pneumatic roller with the environment atmosphere (FIG. 3). Disposed below slot opening 21 and above tilt bearing 14 is a radially extending compressed air pipe 22 connected to a compressor (not shown) installed outside of housing 2. Compressed air pipe 22 is provied with nozzle-shaped openings 22*a* directed towards slot opening 21. As shown in FIG. 2, nozzle-shaped openings 22*a* enclose an angle of 90° between themselves to thereby ensure a uniform injection of compressed air into the pneumatic roller through slot opening 21.

The lower end of shaft 11 is formed to converge to a point. Complementary thereto, tilt bearing 14 is formed with a conical depression 14*a*, as a result of which the pneumatic roller automatically assumes its correct position in the tilt bearing and is safely retained thereat by its own weight.

Upper shaft section 11*a* has its upper end retained in bearing 12, its lower portion being supported by a mounting plate 23 fixedly secured to sidewalls 2*a*, 2*b*. A friction bearing 24 is disposed between upper shaft section 11*a* and mounting plate 23. Fixedly secured to upper shaft section 11*a* between bearings 12 and 24 is a drive transmission wheel 25, preferably in the form of a gear. The drive transmission wheels or gears 25 of the oppositely mounted pneumatic rollers of each pair are preferably dimensioned and arranged in such a manner that the two pneumatic rollers of each pair are rotatable by means of a common chain drive mechanism 26 disposed therebetween. The teeth of gears 25 are thus simultaneously engaged with chain drive mechanism 26. Chain mechanism 26 is surrouned on three sides by a casing rail 27 secured to mounting plate 23 and formed with longitudinally extending slots 27*a* at the locations of drive transmission gears 25 engaging chain mechanism 26. Secured to chain mechanism 26 at longitudinally spaced locations are downwardly projecting coat hooks 28 from which the clothing articles 9*a*, 9*b* are suspended by means of coat hangers 29 (FIG. 1). As shown in FIG. 1, chain mechanism 26 and casing rail 27 are disposed in the upper portion of housing 2 and extend in the longitudinal direction of tunnel finisher 1 through both chambers 3 and 4, to thereby enable clothing articles 9*a*, 9*b* to be conveyed through tunnel finisher 1.

Upper shaft section 11*a* is releasably connected to lower shaft section 11*b* by a coupling device 30. As shown in FIG. 2, coupling device 30 comprises a Z-shaped joint 31 and a clamp sleeve 32. To form Z-shaped joint 31, the lower end of upper shaft section 11*a* is formed with a recessed shoulder followed by an axially extending planar surface joining its free end face. The upper end of lower shaft section 11*b* is of complementary shape, the respective shoulders being of the same depth, so that in the joined state the two shaft sections present the appearance of a continuous shaft 11, with coupling device 30 ensuring effective transmission of the driving torque. This torque-transmitting connection is effectively secured by clamp sleeve 32 mounted for axial displacement on shaft 11.

For improved accessibility in the case of repair or maintenance operations on tunnel finisher 1, particularly for dismounting pneumatic rollers 6*a*, 6*b*, sidewall 2*a* or 2*b* is prpvided with a door 33.

Described in the following is the operation of the tunnel finisher described above, and the dismounting of a pneumatic roller.

To initiate the operation, the pneumatic rollers are supplied with compressed air via compressed air pipe 22 with its nozzle-shaped opening 22*a* and through slot openings 21 in bottom-side discs 17, to thereby cause envelopes 18 to be inflated to a cylindrical shape, so that the two pneumatic rollers of each pair come into contact with each other. The cloak hangers carrying clothing articles are suspended from coat hooks 28 and are then conveyed by chain mechanism 26 through the gap between the pneumatic rollers 5*a*, 5*b* of the first pair into first chamber 3 of the tunnel finisher. Since the envelope of each pneumatic roller yields to pressure, any creasing of the clothing articles is prevented. As soon as a clothing article has entered first chamber 3 by this continuous transport, steam injector assembly 10 is operated to inject steam onto the clothing article from at least two sides, causing the fabric to be relaxed. After the steam treatment of the clothing article 9*b*, the latter passes from first chamber 3 into second chamber 4, while a second clothing article 9*a* enters first chamber 3.

The above described process is repeated in first chamber 3, while the first clothing article 9*b* in second chamber 4 is treated with heated air supplied by the fan for drying and smoothing the fabric, so that the clothing article is free of creases after leaving second chamber 4.

The treatment carried out in second chamber 4 is then repeated for the second clothing article. The dwell times in the steam and hot air treatment chambers are variable by suitably controlling the chain speed. Since the compressed air-filled pneumatic rollers of each pair are in light contact with one another, each chamber is effectively isolated from the other one and from the surrounding atmosphere.

The replacement of the envelope of any pneumatic roller is suitably carried out after dismounting the respective roller from the tunnel finisher. The pneumatic rollers are accessible either from the front or from the rear of the housing, or through the door 33 provided in at least one sidewall. The dismounting operation is initiated by interrupting the supply of compessed air to the lower ends of the pneumatic rollers. Subsequently clamp sleeve 32 is unclamped on shaft 11 and pushed axially upwards onto upper section 11*a* to be clamped thereon. Shaft 11 may now be divided into the upper section 11*a* remaining in the tunnel finisher, and the lower section 11*b* to be dismounted therefrom. To this purpose lower section 11*b* is radially tilted to thereby disengage the recessed shoulders of the Z-shaped joint from one another. The lower section with the envelope to be replaced may then be lifted from its tilt bearing and removed from the respective chamber. The replacement of the envelope is initiated by releasing the clamp ring seated on the bottom-side disc. If the envelope is provided with a fastener, the latter is opened, so that the envelope can be readily pulled off over the top-side disc. Even if there is no such fastener, the envelope can be readily pulled off over the top-side disc, since the inner diameter of the cylindrical envelope is in any case greater than the outer diameter of the discs. The operations of fastening the new envelope on the lower shaft section and of remounting the pneumatic roller in the chamber are suitably carried out in the reverse sequence.

The invention is not limited to the embodiment described above by way of example. In the place of the axially displaceable clamp sleeve it is thus for instance possible to employ a divided clamp sleeve composed of two semi-circular sections. This would permit the height of the tunnel finisher to be reduced to smaller dimensions. The separable connection of the shaft sections could be accomplished by different coupling devices. The lower end of the upper shaft section might for instance be of quadrangular shape to be received in the upper end of the lower section. In this case, the clamp sleeve could be omitted, although the tilt bearing would have to be axially displaceable for separating the connection. The tilt bearing might also be formed with an upwards directed conical projection, in which case the lower end of the lower shaft section would have to be formed with a conical recess. It would also be possible to employ a zip-fastener instead of a Velcro fastener. The arrangement of the nozzle-shaped openings of the compressed air pipes may also be varied within a wide range, inasmuch as any position below the peripheral slot opening of the bottom-side disc may be suitable. Finally the envelope might also be secured to the top-side disc by means of a clamp ring. In this case, an envelope provided with a fastener would present the shape of a simple rectangular sheet.

I claim:

1. A tunnel finisher comprising pneumatic rollers for defining an entrance and an exit, respectively, of a clothing treatment chamber, each said pneumatic roller comprising a shaft supported at its ends in bearings fixedly mounted in a housing, bottom- and top-side discs connected to said shaft, an envelope adapted to be connected to said discs so as to surround a cylindrical space extending therebetween, and further adapted to be supplied with air, and a drive transmission wheel mounted on said shaft above said top-side disc, characterized in that said shaft (11) consists of an upper section (11*a*) fixedly retained in said housing and carrying said drive transmission wheel (25), and a one-piece lower section (11*b*) carrying said discs (16, 17), having its upper end releasably coupled to said upper section (11*a*) and its lower end supported on a tilt bearing (14) permitting it to be tilted outwards of said housing (2) for the replacement of said envelope (18).

2. A tunnel finisher according to claim 1, characterized in that said upper and said lower sections (11*a*, 11*b*) are coupled to one another by means of Z-shaped joint (31), the location of said joint being adapted to be covered by a clamping sleeve (32).

3. A tunnel finisher, particularly according to claim 1, characterized in that said envelope (18) consists of a flat sheet material web adapted to be wrapped around said discs (16, 17) and having a fastener (19) extending over its length.

4. A tunnel finisher according to claim 3, characterized in that said fastener (19) is a Velcro fastener.

5. A tunnel finisher according to claim 4, characterized in that said fastener (19) extends along a helical line in said envelope (18), and in that the upper end of said envelope (18) is formed with a circular hole (18*a*) having an inner diameter slightly greater than the outer diameter of said shaft (11).

6. A tunnel finisher according to claims 3 or 4, characterized in that said fastener (19) extends along a helical line in said envelope (18).

7. A tunnel finisher according to claims 3 or 4, characterized in that the upper end of said envelope (18) is formed with a circular hole (18*a*) having an inner diameter slightly greater than the outer diameter of said shaft (11).

8. A tunnel finisher according to claim 3, characterized in that said fastener (19) extends along a helical line in said envelope (18), and in that the upper end of said envelope (18) is formed with a circular hole (18*a*) having an inner diameter slightly greater than the outer diameter of said shaft (11).

9. A tunnel finisher according to claim 1, characterized in that said top-side disc (16) is releasably supported on said lower section (11*b*) of said shaft (11).

* * * * *